US006123235A

United States Patent [19]

Hsu

[11] Patent Number: 6,123,235

[45] Date of Patent: Sep. 26, 2000

[54] CAULKING GUN

[76] Inventor: Chih-Hua Hsu, No. 162-1, Sec. 3, Hsi-Tun Rd., Hsi-Tun Dist., Taichung, Taiwan

[21] Appl. No.: 09/316,061

[22] Filed: May 21, 1999

[51] Int. Cl.[7] ..... B05B 11/02

[52] U.S. Cl. ..... 222/327; 222/333; 222/386; 192/69.7; 192/89.21

[58] Field of Search ..... 222/333, 390, 222/386, 326, 327; 192/69.7, 89.21

[56] References Cited

U.S. PATENT DOCUMENTS

| | | | |
|---|---|---|---|
| 3,550,815 | 12/1970 | Salonen | 222/333 X |
| 4,615,469 | 10/1986 | Kishi et al. | 222/327 X |
| 4,669,636 | 6/1987 | Miyata | 222/327 X |
| 4,986,454 | 1/1991 | Riley | 222/327 |
| 5,341,958 | 8/1994 | Bayat et al. | 222/333 X |
| 5,450,988 | 9/1995 | Jerdee | 222/333 |
| 5,503,307 | 4/1996 | Wilson et al. | 222/333 X |
| 5,762,239 | 6/1998 | Cossette | 222/390 X |
| 5,775,539 | 7/1998 | Bates et al. | 222/333 X |

*Primary Examiner*—Joseph A. Kaufman
*Assistant Examiner*—John Bastianelli
*Attorney, Agent, or Firm*—Bacon & Thomas, PLLC

[57] ABSTRACT

A caulking gun includes a frame connected in the body of the device, a motor and a first gear respectively connected to the two sidewalls. A shaft extends through the two sidewalls with a sleeve and a board respectively and movably mounted to the shaft. A second gear connected to an end of the shaft so as to engage with the first gear. A collar having a toothed end is fixedly connected to the shaft and engagable with a toothed end of the sleeve. A rack is engaged with the toothed outside of the sleeve and contacts the rear end of a tube of caulking. The board is pushed by a spring toward the sleeve and has two recesses defined in one of two sides thereof. The trigger has two protrusions so that the board is pushed by the protrusion to disengage from the collar when the trigger is not pulled. When the trigger is pulled, the protrusions are received in the recesses and the sleeve is engaged with collar.

7 Claims, 6 Drawing Sheets

CAULKING GUN

FIELD OF THE INVENTION

The present invention relates to a caulking gun, and more particularly, to an improved electric caulking gun comprising a clutch device so as to prevent the caulking from dropping when the motor stops.

BACKGROUND OF THE INVENTION

A conventional caulking gun uses pneumatic power or manual way to drive a press rod into the rear end of a tube of caulking on the caulking gun to let the caulking adhered to the desired position on an object. Generally, the press rod is in contact with the rear end of the tube of caulking no matter whether the pneumatic device is running or not so that when the pneumatic device moves the press rod, the caulking flows from the front end of the tube. Nevertheless, the caulking is a thick and flexible material so that when the pneumatic device stops, the press rod still firmly contacts the rear end of the tube so that the caulking will exert a force on the press rod and a reaction force is applied to the caulking by the press rod to make an extra small amount of the caulking flow from the front end of the tube. Furthermore, when the press rod is pulled back to install a new tube of caulking in the caulking gun, the pneumatic device has to be controlled not to exert a force to the tube of caulking and this action takes time and not efficient.

The present invention intends to provide a caulking gun that has a clutch device to release the press rod from the motor shaft and a planet gear set generates a high torque to the rack.

SUMMARY OF THE INVENTION

In accordance with one aspect of the present invention, a caulking gun comprises a body having a handle and a barrel respectively extending from the body. A frame has two sidewalls and an end wall connected between the two sidewalls. A motor and a first gear are respectively connected to the two sidewalls, wherein the first gear is driven by the motor. A rack extends through the end wall and is located between the two sidewalls.

A shaft extends through the two sidewalls and has a second gear connected to one of two ends thereof, the second gear engaged with the first gear. A clutch device comprises a collar fixedly mounted to the shaft, and the collar has first toothed end. A sleeve is movably mounted to the shaft and has a plurality of teeth defined in the outside thereof so that the teeth of the sleeve are engaged with the rack. The sleeve has a second toothed end defined in the first end thereof so as to be engagable with the first toothed end of the collar. A board is movably mounted to the shaft and connected to the second end of the sleeve. The board has at least one recess defined in one of two sides thereof and is biased by a spring.

A pin has one end connected to one of the sidewalls and the other end extends through the board. A trigger is mounted on the pin and has at least one protrusion extending therefrom which is movably received in at least one recess.

The object of the present invention is to provide a caulking gun wherein a high torque is generated by using a planet gear set cooperated with the motor.

Another object of the present invention is to provide a caulking gun wherein the rack will not firmly contact the tube when the motor is stopped so as to prevent extra caulking from flowing out from the tube.

Further objects, advantages, and features of the present invention will become apparent from the following detailed description with appropriate reference to the accompanying drawings.

DETAILED DESCRIPTION OF THE PREFERRED EMBODIMENT

Figure 1:
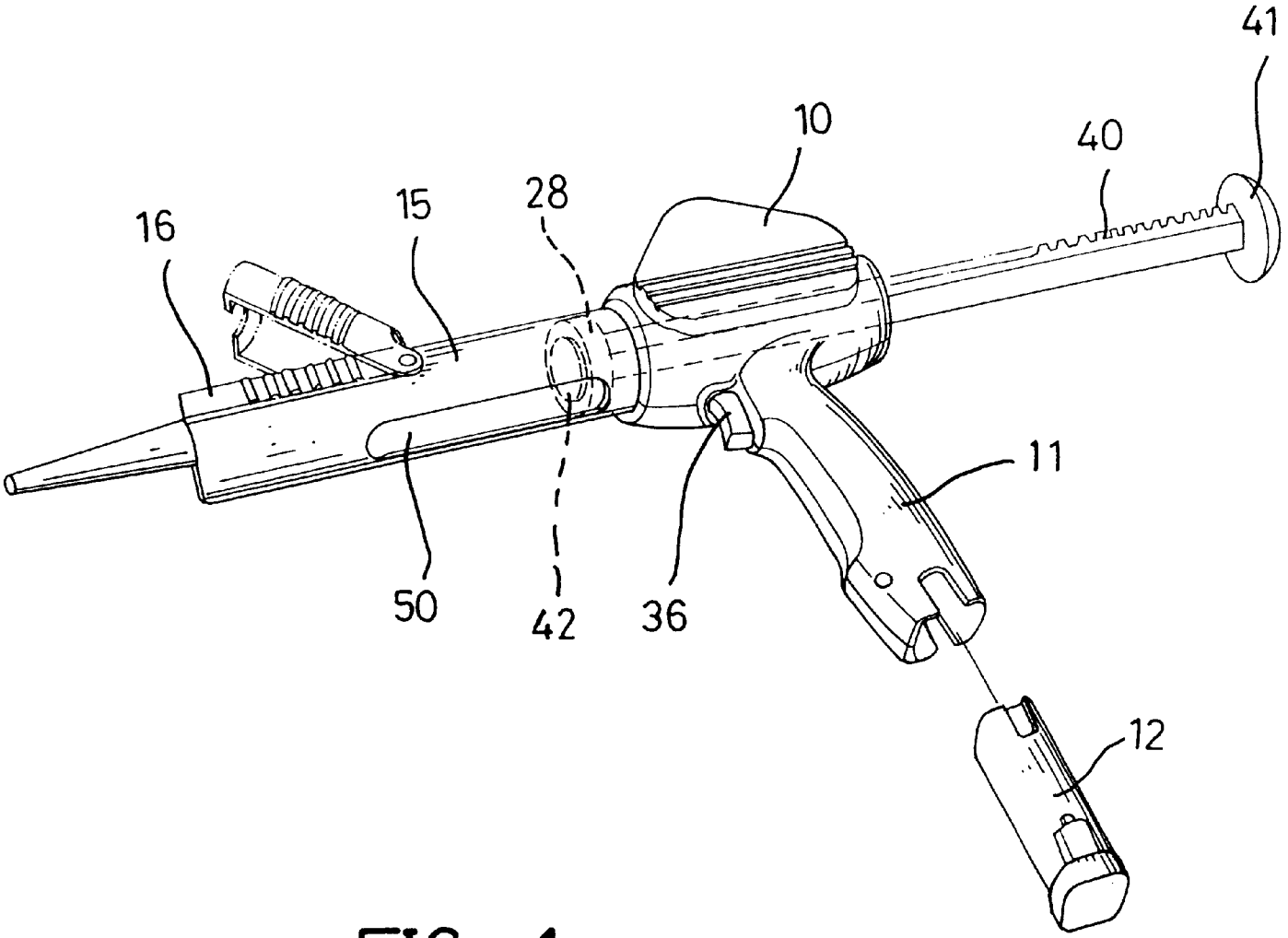
FIG. 1 is an exploded view of the caulking gun and a battery in accordance with the present invention.
Figure 2:
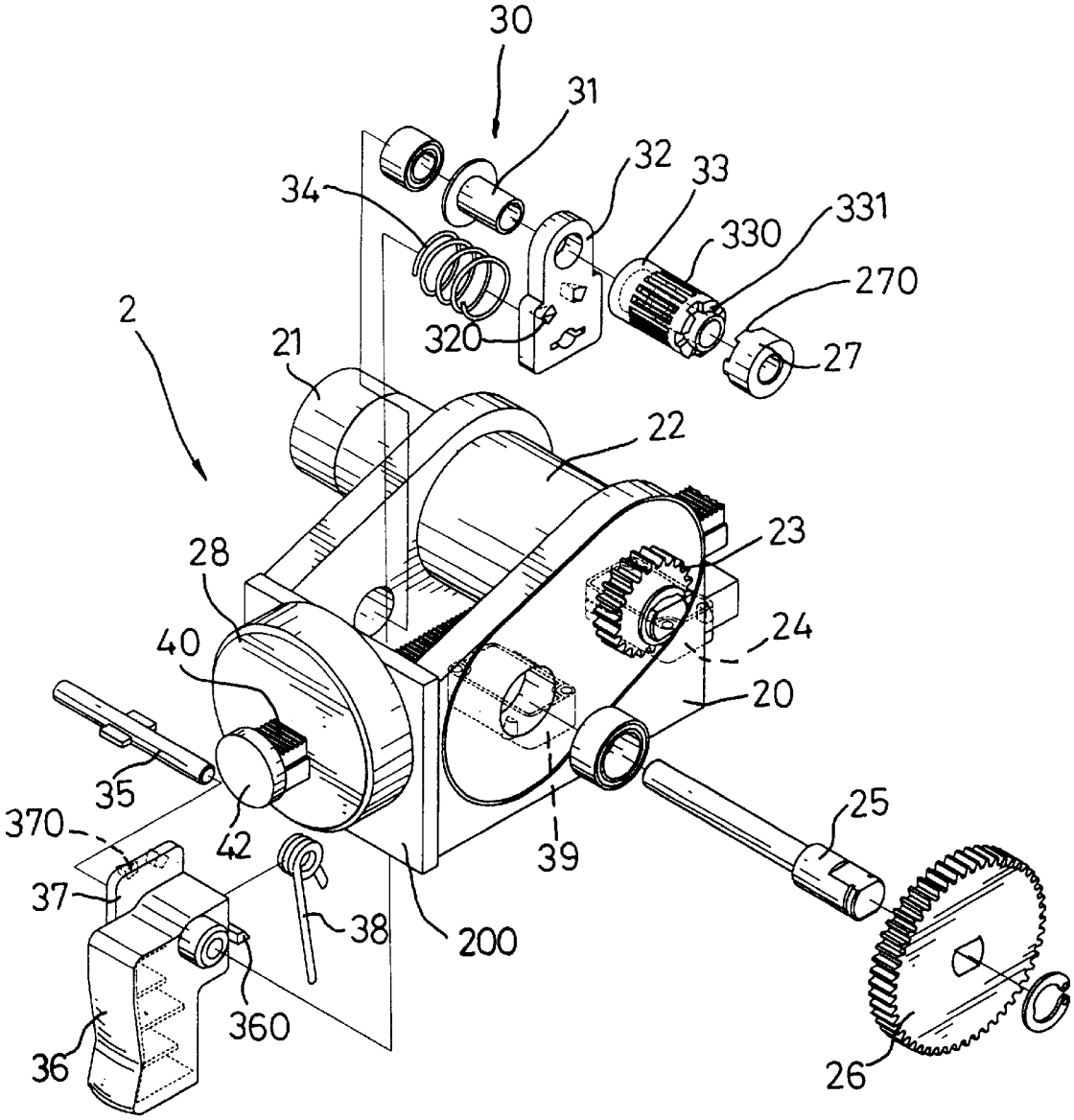
FIG. 2 is an exploded view of the frame, the clutch device and the trigger of the caulking gun in accordance with the present invention.
Figure 3:
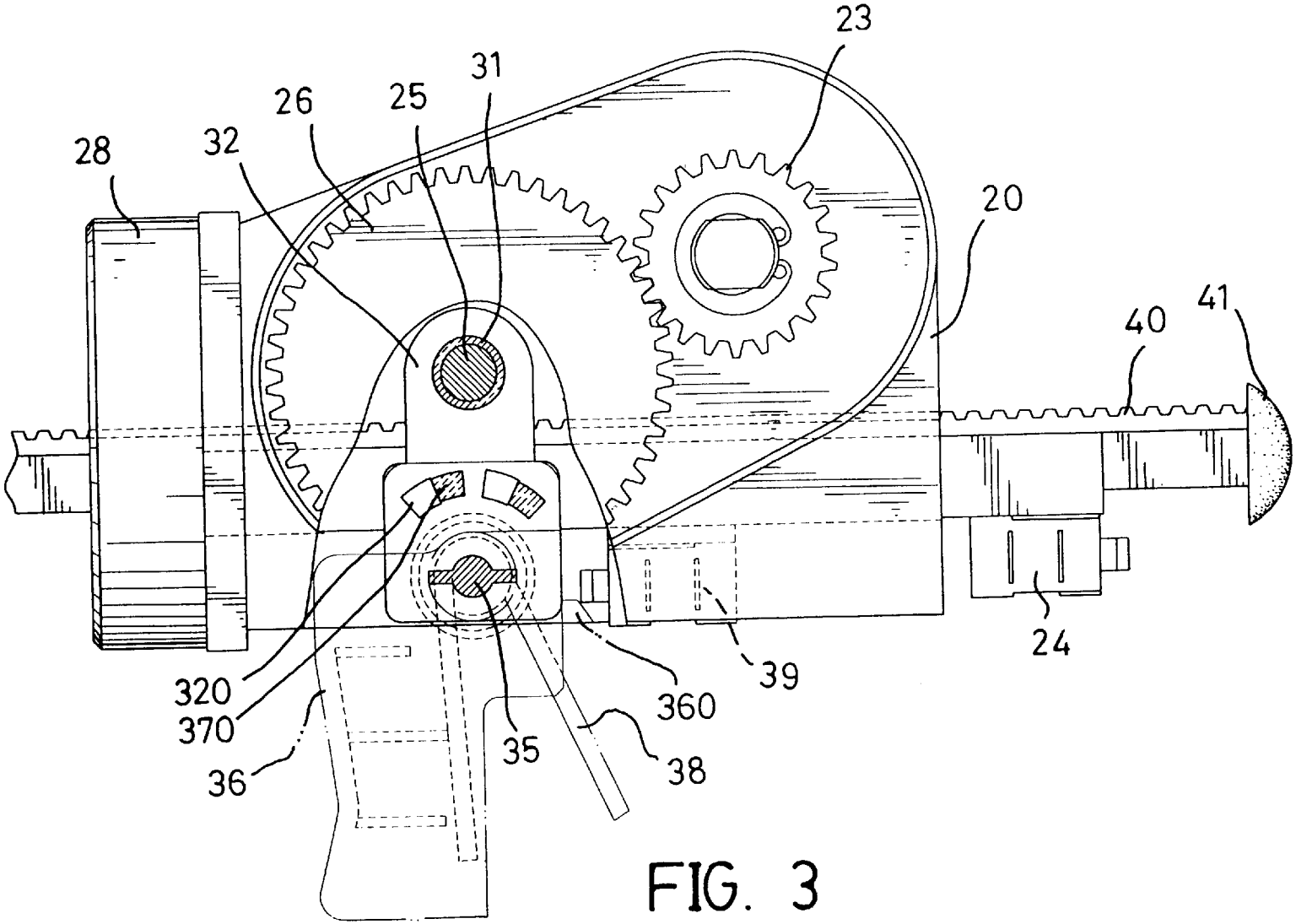
FIG. 3 is a side elevational view, partly in section, of the caulking gun in accordance with the present invention.

Referring to FIGS. 1 to 5, the caulking gun in accordance with the present invention comprises a body (10) having a handle (11) and a barrel (15) respectively extending from the body (10). The barrel (15) has a cover (16) pivotally connected to the wall of the barrel (15) so as to conveniently insert a tube (50) of caulking into the barrel (15). A rechargeable battery (12) is received in the handle (11). A frame (2) has two sidewalls (20) and an end wall (200) connected between the two sidewalls (20). The frame (2) is received in the body (10), a motor (21) is connected to one of the sidewalls (20), and a first gear (23) is connected to the other sidewall (20). The first gear (23) is driven by the motor (21) by a reduction gear set in a casing (22) between the two sidewalls (20). A planet gear set is used to be the reduction gear set to generate a high torque to the rack (40) which will be described hereinafter. The end wall (200) has a circular member (28) connected to the outside thereof to engage the barrel (15). A rack (40) extends through the end wall (200) and the circular member (28) and is located between the two sidewalls (20). A plunger (42) is connected to the first end of 20 the rack (40) in the barrel (15) so as to contact the rear end of the tube (50) of caulking in the barrel (15), and an end head (41) is connected to the second end of the rack (40).

A shaft (25) extends through the two sidewalls (20) and has a second gear (26) connected to one of two ends thereof, and the second gear (26) is engaged with the first gear (23).

A clutch (30) comprises a collar (27) fixedly mounted to the shaft (25), and the collar (27) has first toothed end (270). A sleeve (33) is movably mounted to the shaft (25) with a bushing (31) connected between the shaft (25) and the sleeve (33). The sleeve (33) has a plurality of teeth (330) defined in the outside thereof so as to be engaged with the rack (40). The sleeve (33) has a second toothed end (331) defined in the first end thereof, and the second toothed end (331) is engagable with the first toothed end (270) of the collar (27). A board (32) is movably mounted to the shaft (25) and is connected to the second end of the sleeve (33). The board (32) is biased by a spring (34) toward the sleeve (33), and two recesses (320) are defined in one of two sides of the board (32).

A pin (35) has one end connected to one of the sidewalls (30) and the other end extends through the board (32). A trigger (36) is mounted on the pin (35) and has a plate (37) extending therefrom which has two protrusions (370) extending therefrom.

A first limit switch (39) is located beside the trigger (36) and the trigger (36) has a flange (360) extending therefrom so that when the trigger (36) is pulled, the flange (360) contacts the first limit switch (39) to activate the motor (21). The trigger (36) is biased by a torsion spring (38), and the force of the torsion spring (38) is greater than that of the spring (34). A second limit switch (24) is located beside the rack (40) so that when the rack (40) moves to a position where the caulking runs out, the end head (41) contacts the second limit switch (24) and stops the motor (21).

Figure 4:
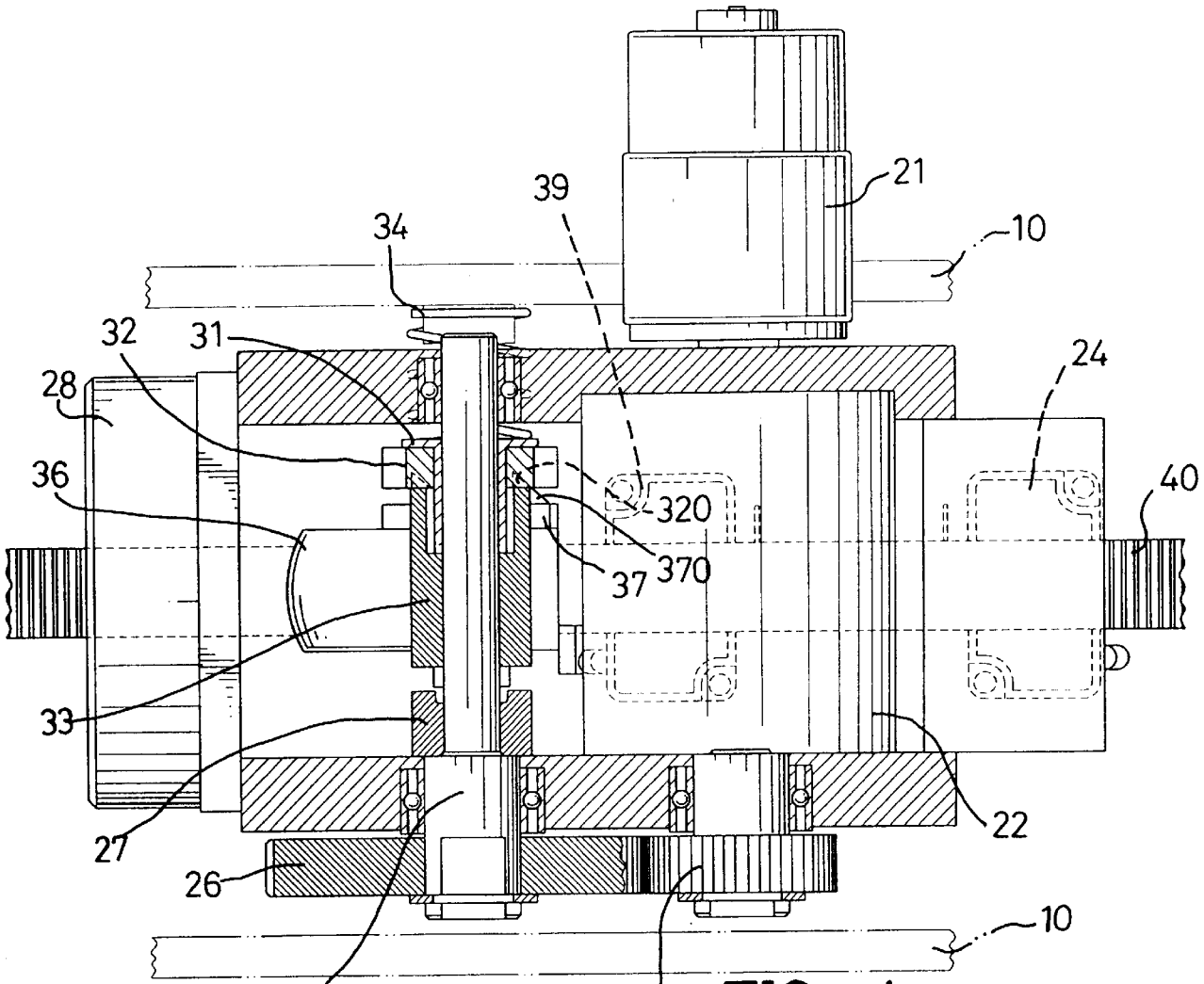
FIG. 4 is a top plan view to show the clutch device in accordance with the present invention when the trigger is not yet pulled.
Figure 5:
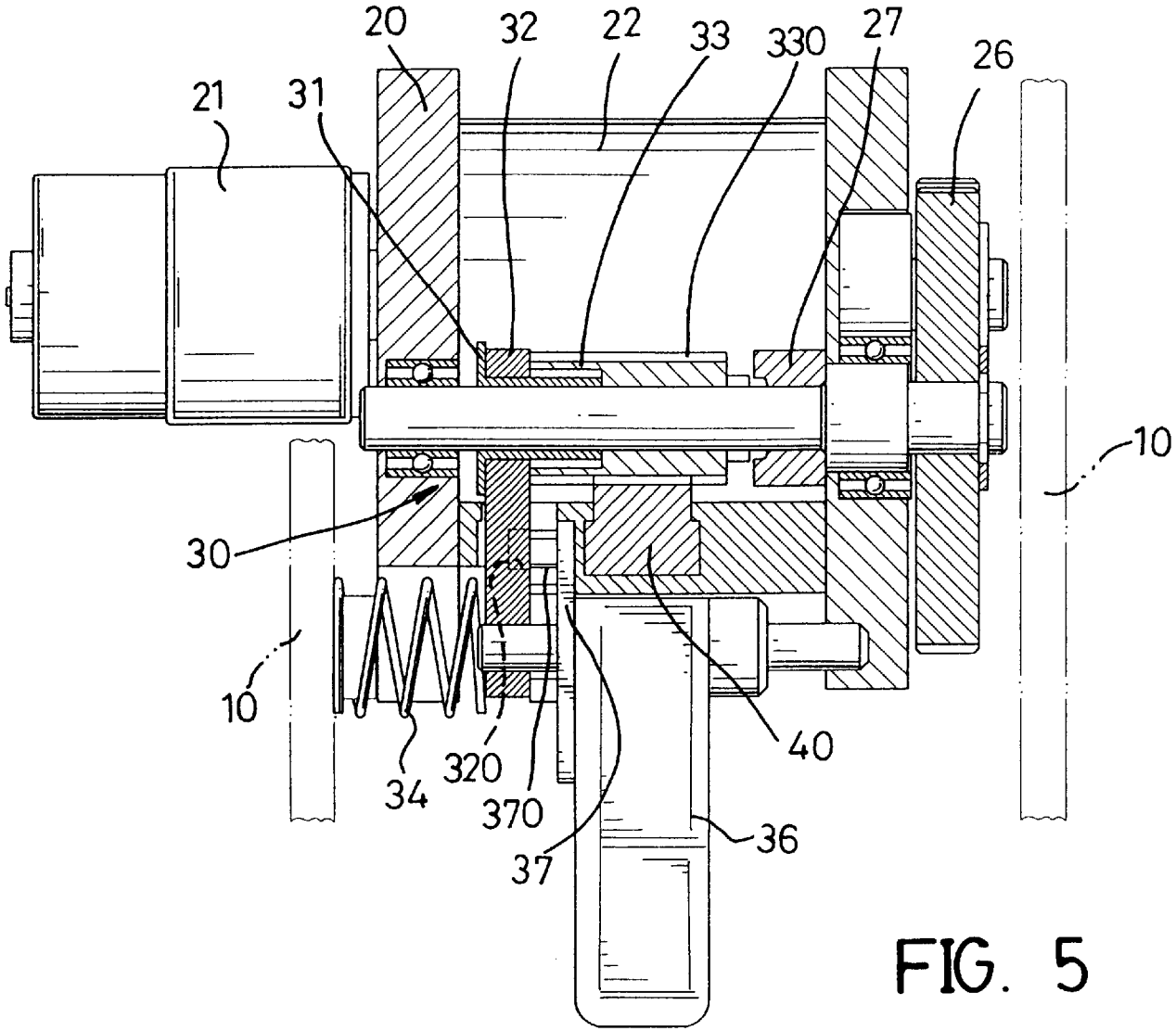
FIG. 5 is a front plan view in partial section of the clutch device in accordance with the present invention when the trigger is not yet pulled.

When the trigger (36) is not pulled, the protrusions (370) on the plate (37) are not received in the recesses (320) of the board (32) so that the board (32) together with the sleeve (33) are pushed by the protrusions (370) away from the collar (37) as shown in FIGS. 4 and 5. At this position, the rack (40) can be pulled without affecting the motor (21) because the sleeve (33) is disengaged from the collar (27). When the trigger (36) is pulled, the protrusions (370) are moved into the recesses (320), the board (32) and the sleeve (33) are pushed by the spring (34) to let the sleeve (33) engage with the collar (27) so that the motor (21) can rotate the sleeve (33) and the rack (40) is moved. The rack (40) is stopped when the second limit switch (24) is pushed by the end head (41).

Figure 6:
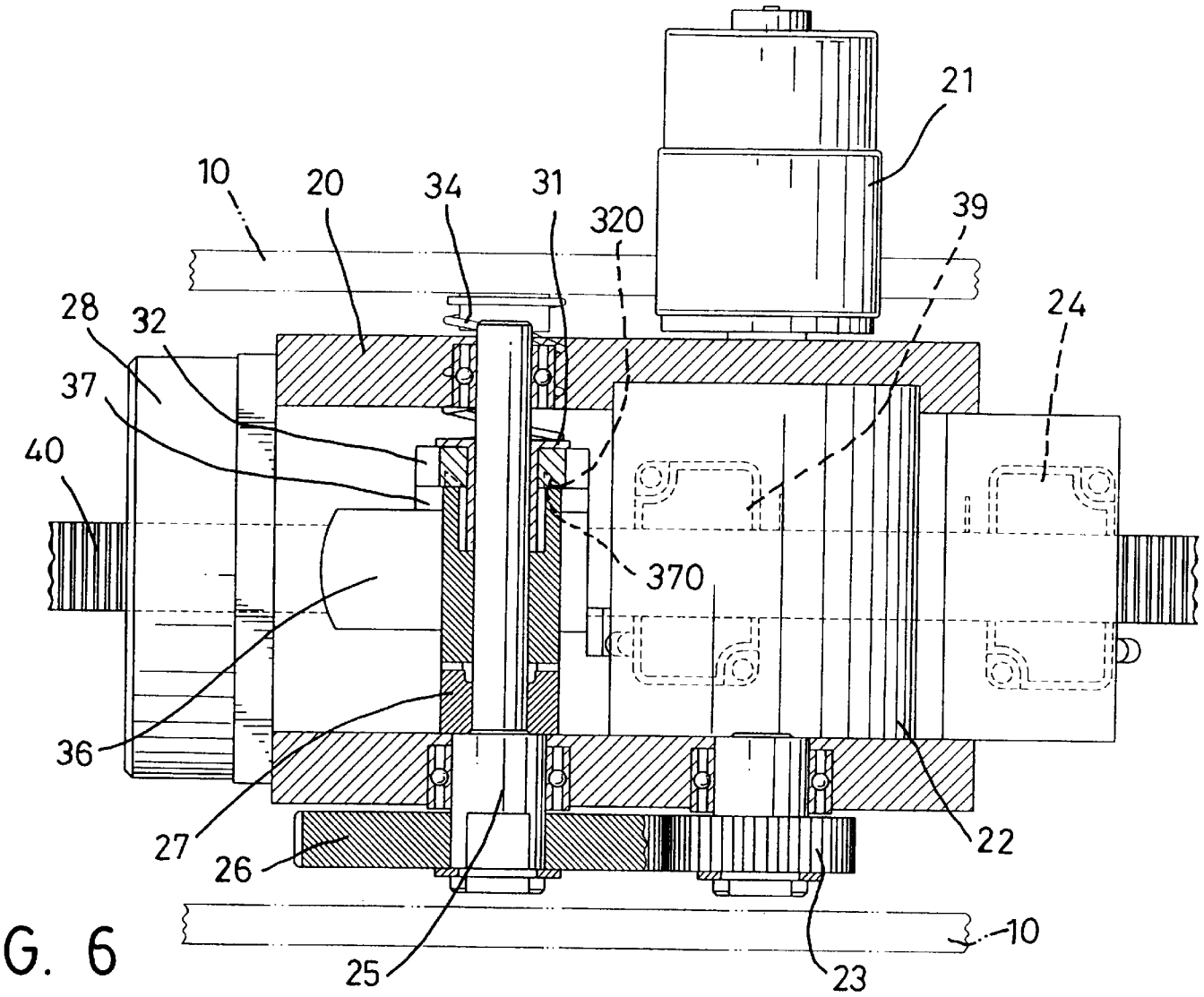
FIG. 6 is a top plan view in partial section of the clutch device in accordance with the present invention when the trigger is pulled.

When the trigger (36) is released, as shown in FIG. 6, the protrusions (370) are again removed from the recesses (320) to disengage the sleeve (33) from the collar (27). The sleeve (33) now is freely rotatable about the shaft (25) so that the rack (40) will not exert a force on the tube (50) and there will be no extra caulking will flow from the front end of the tube (50). Besides, the rechargeable battery allows the caulking gun of the present invention to be easily change its electric power source without complicated processes.

Although the invention has been explained in relation to its preferred embodiment, it is to be understood that many other possible modifications and variations can be made without departing from the spirit and scope of the invention as hereinafter claimed.

What is claimed is:

1. A caulking gun comprising:

a body (10) having a handle (11) and a barrel (15) respectively extending from said body (10);

a frame (2) having two sidewalls (20) and an end wall (200) connected between said two sidewalls (20), a motor (21) connected to one of said sidewalls (20) and a first gear (23) connected to the other sidewall (20), said first gear (23) driven by said motor (21), a rack (40) extending through said end wall (200) and located between said two sidewalls (20);

a shaft (25) extending through said two sidewalls (20) and having a second gear (26) connected to one of two ends thereof, said second gear (26) engaged with said first gear (23), a clutch device (30) comprising a collar (27) fixedly mounted to said shaft (25) and said collar (27) having a first toothed end (270), a sleeve (33) movably mounted to said shaft (25) and a plurality of teeth (330) defined in the outside thereof, said teeth (330) of said sleeve (23) engaged with said rack (40), said sleeve (33) having a second toothed end (331) defined in the first end thereof and said second toothed end (331) engagable with said first toothed end (270) of said collar (27), a board (32) movably mounted to said shaft (25) and connected to the second end of said sleeve (33), said board (32) having at least one recess (320) defined in one of two sides thereof, said board (32) biased by a spring (34) toward said sleeve (33), and a pin (35) having one end thereof connected to one of said sidewalls (30) and the other end of said pin (35) extending through said board (32), a trigger (36) mounted to said pin (35) and having at least one protrusion (370) extending therefrom which is movably received in said at least one recess (320).

2. The caulking gun as claimed in claim 1 further comprising a plunger (42) connected to the first end of said rack (40) in said barrel (15).

3. The caulking gun as claimed in claim 1, wherein said end wall (200) has a circular member (28) to engage said barrel (15).

4. The caulking gun as claimed in claim 1 further comprising a first limit switch (39) located beside said trigger (36) and said trigger (36) has a flange (360) extending therefrom so that when said trigger (36) is pulled, said flange (360) contacts said first limit switch (39) to actuate said motor (21).

5. The caulking gun as claimed in claim 1 further comprising a second limit switch (24) located beside said rack (40), an end head (41) connected to the second end of said rack (40) so that when said rack (40) moves to a limit position, said end head (41) contacts said second limit switch (24) to stop said motor (21).

6. The caulking gun as claimed in claim 1, wherein said barrel (15) has a cover (16) pivotally connected to the wall of said barrel (15).

7. The caulking gun as claimed in claim 1 further comprising a bushing (31) mounted to said shaft (25) and located between said shaft and said board (32).

* * * * *